US005968891A

United States Patent [19]

Mallari et al.

[11] Patent Number: 5,968,891

[45] **Date of Patent: *Oct. 19, 1999**

[54] PROCESS FOR PREPARING DETERGENT COMPOSITION HAVING HIGH BULK DENSITY

[75] Inventors: Gil Albarracin Mallari, Neshanic Station, N.J.; Hans Jorgen Andresen, Roskilde, Denmark; Joseph Raymond Schorle, Middletown, N.J.

[73] Assignee: Colgate-Palmolive Co., New York, N.Y.

[ * ] Notice: This patent is subject to a terminal disclaimer.

[21] Appl. No.: 08/947,358

[22] Filed: Oct. 8, 1997

Related U.S. Application Data

[63] Continuation-in-part of application No. 08/481,234, Jun. 8, 1995, Pat. No. 5,707,958, which is a continuation of application No. 08/090,823, Jul. 13, 1993, abandoned.

[51] Int. Cl.[6] ..... C11D 11/00

[52] U.S. Cl. ..... 510/444; 510/347; 510/361; 510/457; 510/471; 510/480; 510/507; 510/509; 264/117; 264/140

[58] Field of Search ..... 510/444, 457, 510/347, 361, 471, 480, 507, 509; 264/117, 140

[56] References Cited

U.S. PATENT DOCUMENTS 5,133,924 7/1992 Appel et al. ..... 510/444

5,707,958 1/1998 Mallari et al. ..... 510/444

FOREIGN PATENT DOCUMENTS 0339996 11/1989 European Pat. Off. .

0340013 11/1989 European Pat. Off. .

0351937 1/1990 European Pat. Off. .

*Primary Examiner*—Lorna M. Douyon

*Attorney, Agent, or Firm*—Bernard Lieberman

[57] ABSTRACT

A process for the preparation of a granular detergent composition or component having a bulk density of at least about 700 g/l up to a bulk density of about 1100 g/l comprising: (a) providing a low density, particulate detergent or component stock comprising an organic surfactant, a water-soluble inorganic salt and, optionally, other materials, the stock having a bulk density of no more than about 600 g/l; (b) subjecting the low density, particulate stock to high-shear agglomeration whereby the particulate stock is subjected to high-shear forces in intimate contact with a liquid consisting essentially of water in an amount and for a time sufficient (1) to fluidize, wet with water, and mechanically mill the stock to a smaller particle size and (2) to partially agglomerate the wetted, milled stock; (c) subjecting the partially agglomerated stock to rotating agglomeration for a time sufficient to produce, when dried, a further agglomerated, granular detergent composition or component having a bulk density of at least about 700 g/l; and (d) drying the further agglomerated detergent composition or component. The product produced by the method is also disclosed.

9 Claims, No Drawings

PROCESS FOR PREPARING DETERGENT COMPOSITION HAVING HIGH BULK DENSITY

RELATED APPLICATION

This application is a continuation in part application of prior application U.S. Ser. No. 8/481,234 filed on Jun. 8, 1995 now U.S. Pat. No. 5,707,958 which is a continuation of application U.S. Ser. No. 8/090,823 filed on Jul. 13, 1993 now abandoned the disclosures of which are incorporated herein by reference.

BACKGROUND OF THE INVENTION

The present invention relates to a granular detergent composition or component thereof having a high bulk density and a process for its preparation.

DISCUSSION OF THE PRIOR ART

Most conventional powdered detergents are low-density products. Recently, for facilitation of transportation of detergents, carrying of detergents by consumers and storage of detergents, the demand for compact high-density detergents is increasing. Moreover, environmental concerns which dictate the use of less packaging materials have enhanced the demand for higher density detergents.

Detergent powders are presently prepared according to one of two main types of methods. One method utilizes a spray-drying technique whereby an aqueous slurry of the detergent composition or a component thereof is spray-dried in a tower. Generally, however, spray-drying produces a powder having a density only in the range of from about 300 to 600 g/l.

The second type of process involves dry-mixing the components of the composition followed by agglomeration of the resulting powder with liquids. However, only high density powders can be produced by this method.

The most important factors which determine the bulk density of the final detergent powder are the chemical composition of the slurry in the case of a spray-drying process, and the bulk density of the starting materials in the case of a dry-mixing process. Both factors can only be varied within a limited range. For example, the bulk density of a dry-mixed powder can be increased by increasing its content of relatively dense sodium sulfate, but this does not contribute to the detergency of the powder so that its overall properties as a washing powder will generally be adversely affected.

Therefore, a substantial increase in bulk density can only be effectively achieved by processing steps which lead to densification of the detergent powders which do not adversely affect its detergent properties. There are several processes known in the art leading to such densification. Particular attention has thereby been paid to densification of spray-dried powders by a post-tower treatment.

In Seifen-Öle-fette-Wachse, Vol. 114, No. 8, pages 315–316 (1988), author B. Ziolkowsky describes a process for the continuous manufacture of a detergent powder having an increased bulk density by treating a spray-dried detergent composition in a two-step post-tower process which can be carried out in a Patterson-Kelly Zig-Zag® agglomeration apparatus. In the first part of this machine, the spray-dried powder is fed into a rotating drum in which a liquid dispersing wheel equipped with cutting blades is rotating. In this first processing step, a liquid is sprayed onto the powder and is thoroughly admixed therewith. By the action of the cutters, the powder is pulverized and the liquid causes agglomeration of the pulverized powder to form particles having an increased bulk density compared to that of the starting material.

The bulk density increase obtained is dependent on a number of factors such as the residence time in the drum, its rotational speed and the number of cutting blades. After a short residence time, a light product is obtained; after a long residence time, a denser product is obtained. In the second part of the machine which is essentially a rotating V-shaped tube, the final agglomeration and conditioning of the powder take place. After the densification process, the detergent is cooled and/or dried.

An example of a non-tower route for preparing a high bulk density detergent powder is set forth in Japanese Patent Application No. 60-072,999 (Kao). This application discloses a batch process whereby a detergent sulfonic acid, sodium carbonate, water and, optionally, other ingredients are brought into a high-shear mixer, followed by cooling to 40° C. or below, pulverizing with zeolite powder and granulating.

Although it is possible by means of one or more of the above-mentioned processes to prepare detergent powders having an increased bulk density, each of those routes has its own disadvantages and does not increase the bulk density of the composition to a sufficiently high level.

U.S. Pat. No. 5,164,108 (Appel et al) describes a process for preparing a granular detergent having a bulk density of at least 550 g/l by feeding a liquid acid precursor of an anionic surfactant, an alkaline material and other ingredients into a high speed mixer/densifier whereby the acid is neutralized to obtain a powder, followed by mixing in a granulator/densifier to reduce the intraparticle porosity of the powder.

Australian Patent No. 125,730 (Holuba) discloses a method of preparing spray-dried soaps and detergents and particularly relates to processes for increasing the apparent specific gravity and uniformity in size of the particles and decreasing the amount of fines or dust. As described in the patent, one prior art method for increasing the apparent specific gravity involves spray-drying particles which are then sprayed with water for modifying the characteristics of the particles. The moistened particles are tumbled or otherwise agitated so that they not only are thoroughly coated with water, but are compacted and densified. Holuba notes that one of the problems associated with this prior art method is that some of the particles thus treated are excessively moistened and agglomerate, while others may remain untreated in the dry state. In Holuba's process, the spray-dried particles are subjected to the action of steam either alone or in combination with water while tumbling or otherwise agitating, thereby achieving a uniformity in compactness and density. The particles are subsequently dried to remove excess moisture. In the typical operation, the spray-dried particles are passed through a rotating drum and contacted with steam or steam/water.

U.S. Pat. No. 4,869,843 (Saito et al) describes a process for producing a high-density, granular, concentrated detergent composition. The process provides for preparing spray-dried particles comprising 20–60% by weight of an organic, e.g., anionic, surfactant and a mixture of several inorganic salts, including tripolyphosphates, carbonates, aluminosilicates and the like. As discussed in column 12, lines 42 et seq., the spray-dried particles have a bulk density of about 0.3 g/cm$^3$. The particles are placed in a high-speed mixer and contacted with a composition comprising fine zeolite wetted with water to obtain a high bulk density granular detergent of 0.6 to 0.8 g/cm$^3$. Saito notes that the water in the composition acts as a binder for the granulation of the ground detergent powder.

U.S. Pat. No. 4,999,138 (Nebashi et al) describes a similar process for producing a high-density, granular, concentrated detergent composition. However, the spray-dried particles are contacted with an enzyme, zeolite and water.

U.S. Pat. No. 5,160,657 (Bortolotti et al) relates to high bulk detergent compositions wherein the spray-dried particulate material is treated in a first high-speed mixer/densifier for a very short period, contacted with zeolite in a second moderate-speed mixer/densifier for a longer period, and finally dried.

U.S. Pat. Nos. 4,738,793 (Travill) and 4,923,628 (Appel et al) relate to a high bulk density detergent prepared by spray-drying a slurry and post-dosing the resulting particles with sodium sulfate.

U.S. Pat. No. 4,652,391 (Balk) appears to produce a high density powder granular detergent composition by homogenizing a heated slurry and spraying the slurry in a drying tower.

It is an object of the present invention to provide a novel process for the preparation of granular detergent compositions or components thereof having very high bulk densities not heretofore attainable.

It is another object of the present invention to provide novel granular detergent compositions or components thereof having extremely high bulk densities.

SUMMARY OF THE INVENTION

These and other objects are realized by the present invention, one embodiment of which comprises a process for the preparation of a granular detergent composition or component having a bulk density of at least about 700 g/l and up to a bulk density of about 1100 g/l comprising:

a. providing a low density, particulate detergent or component stock comprising an organic surfactant, a water-soluble inorganic salt and, optionally, other materials, the stock having a bulk density of no more than about 600 g/l;

b. subjecting the low density, particulate stock to high-shear agglomeration whereby the particulate stock is subjected to high-shear forces in intimate contact with a liquid consisting essentially of water in an amount and for a time sufficient (1) to fluidize, wet with water, and mechanically mill the stock to a smaller particle size and (2) to partially agglomerate the wetted, milled stock;

c. subjecting the partially agglomerated stock to rotating agglomeration for a time sufficient to produce, when dried, a further agglomerated, granular detergent composition or component having a bulk density of at least about 700 g/l; and d. drying the further agglomerated detergent composition or component.

Another embodiment of the invention resides in a granular detergent composition or component having a bulk density of at least about 700 g/l comprising an organic surfactant, a water-soluble inorganic salt and, optionally, other materials.

DETAILED DESCRIPTION OF THE INVENTION

The invention is predicated on the discovery that subjecting a low density granular detergent or component stock to a two-step agglomeration process, i.e., a high-shear agglomeration in the presence of water to fluidize, wet and mechanically mill the stock to a smaller particle size while partial agglomeration of the reduced particles takes place, followed by subjecting the partially agglomerated, wet stock to rotating agglomeration produces, upon drying, a detergent or component powder having heretofore unattainable bulk densities up to about 1100 g/l.

Although it has been suggested heretofore to spray-dry a slurry of detergent or component and then to agglomerate the spray-dried product according to a two-step agglomeration process including high-shear agglomeration in the presence of an aqueous liquid, followed by rotational agglomeration, all such methods require that the aqueous liquid employed in the high-shear agglomeration step contain at least a portion of the ingredients of the final detergent or component composition. It was apparently believed that the presence of these detergent components in the liquid added to the high-shear agglomeration step was critical to agglomeration taking place.

Surprisingly, according to the present invention, it has been discovered that the utilization of a liquid in the high-shear agglomeration step consisting only essentially of water, i.e., not containing any of the components of the detergent or component composition, results in the ultimate production of a granular detergent or component composition having heretofore unattainable high bulk densities.

It is preferred to provide the initial detergent or component (hereinafter, "detergent" refers to the final detergent composition or a component thereof) feed stock for the high shear agglomeration steps by spray-drying the detergent slurry produced in the crutcher. Preferably, the spray-dried stock has a bulk density of from about 300 to about 600 g/l.

It has been reported [Koppel, XXIII Jornada, pages 11–13, del CED, Barcelona, Spain (March, 1992)] that when producing high density powder, it is important that the major builders be relatively heavy, i.e., when a formulation contains 50% spray-dried product with a density of 300 g/l, it is almost impossible to reach over 700 g/l. As a result, to increase the density of a detergent, the spray-dried fraction must be normally be minimized to 20–40%, and the remaining builders will be heavy with individual densities over 600 g/l. An exception is zeolite which can be low density on the condition that it is the non-agglomerated fine base powder (density normally 3–400 g/l). When using fine zeolite powder in the post-agglomerator, the requirements to the amount of agglomeration liquid increase.

If only non-ionic surfactant is used, the increase could even be desired, but the problem could arise that the end product gets a wet and sticky appearance and has poor flow properties. The density will be dependent on the agglomeration system being limited to a certain level for a given formulation with a given kind of raw material. It seems that the density curve (which is based on a comparison between work input in the agglomerator and density) will reach a maximum; in Koppel's experience with standard raw materials and formulation, this value is between 650 and 750 g/l.

Koppel reports that the upper limit on density for a spray dryer/spray agglomerator system seems to be 750 g/l, but by changing to non-standard heavy raw materials and modifying the formulation to suit the desire for high density, a value as high as 900 g/l is achievable. However, this is more the exception than the rule.

According to the method of the present invention, the entire detergent composition can comprise the feed to the spray dryer and, by employing only water in the subsequent agglomeration step, products having bulk densities of 900 g/l and higher are the rule.

Koppel [supra] further reported that where the agglomerator is placed after the spray dryer, and some builders in powder form are now mixed with the spray-dried powder and agglomerated with an agglomeration liquid, the spray dryer will have a different function.

Koppel further states that when by-passing the spray dryer for some builders, the amount of the final formulation which is spray-dried will drop from approximately 80% down to 25–40% and mostly contain the concentrated anionic surfactant. In practice, a carrier such as sodium sulfate, some zeolite or carbonate is used to enable the spray-drying of the soap fraction. New production limitations will occur since the large amount of fatty matter will require lower inlet temperature to avoid discoloring of the powder due to heat. The tower capacity will, of course, fall due to the temperature limitation, but on the other hand, less product is required to maintain total capacity. The investment in the agglomeration system will easily and quickly be paid back, Koppel reports, if capacity increase can be utilized. As an example, in a factory producing 10 tons/hour, where 80% of the output is spray-dried and 20% is post-added, the shift to spray-drying and agglomeration, where only 40% is spray-dried, will significantly increase the capacity. With the new system, a more concentrated anionic capacity in the tower will not be 8 tons/hour, but maybe 6 tons/hour. The total capacity will then be increased to 15 tons/hour after the rebuild, since the tower is limited to 40% of the total formulation. Very often, the bottleneck will then not be in the production, but in the packaging section.

According to the process of the present invention where 100% of the final composition is spray-dried or otherwise provided as the feed stock for the agglomeration steps, all of the above reported disadvantages are avoided and, unexpectedly, very high bulk densities are also achieved, thereby greatly enhancing the efficiency of the drying/agglomeration operation.

Although it will be understood by those skilled in the art that any combination of high-shear/rotational agglomeration system can be employed in the practice of the method of the invention, it is preferred to utilize the Zig-Zag® type agglomerator described above.

The Zig-Zag® was developed by Patterson-Kelly and is based on the twin-shell or V-blender. The unit has two zones, the first of which is a rotating drum section where the raw materials are added and the primary agglomeration/densification takes place. The second section is a V-blender where the beads are rounded off into spherical granules and the fines are rolled into bigger particles. The liquid binder is added into the drum centrifugally via the high-speed rotation of the intensifier bar with cutting knives. The design of the drum and V-section constantly moves the powder forward and backward. This random splitting results in intimate mixing and agglomeration of the fresh feed powder to the drum contents.

Densification is mainly accomplished by minimizing the void spaces (formed, e.g., during spray-drying) with the individual beads, also referred to as the porosity of the beads. This mechanism occurs in the drum section. Some density is also gained from improved packing of the powder bed due to the sphericity of the granules (this occurs in the V-section), also referred to as the porosity of the packed bed. The first mechanism is accomplished by initially softening the powder with the liquid binder and then "hammering" it with the rotating knives. The hammering collapses the void spaces within each bead and, at the same time, prevents lumps from forming. The critical factors, therefore, include the plastic property of the base beads, degree of hammering and time of hammering. The last two items are measures of the degree of work or energy applied to the beads during deformation. These factors are controlled by the formulation, type and amount of wetting liquid, speed of the intensifier bar and retention time in the drum.

While it is preferred to employ pure water in the high-shear agglomeration steps, it will be understood by those skilled in the art that the liquid may contain the ordinary impurities normally associated with ambient or tap water. There may also be added to the liquid silicate solution, anionic base slurry and polymers (e.g., cellulosic, i.e., Methocel®, PVP, etc.), provided that 100% of the base detergent composition comprises the feed stock to the agglomeration step.

The detergent composition comprising the feed stock for the agglomeration step may comprise the components in amounts within the ranges set forth in the table below:

| | RANGES | |
|---|---|---|
| Components | Broad | Preferred |
| Moisture | 3–15 | 5–10 |
| LAS (linear alkylbenzene sulfonate) | 0–12 | 4–8 |
| Non-ionic | 0–10 | 0–5 |
| TPP | 0–60 | 0–45 |
| Soda Ash | 0–10 | 0–7 |
| Zeolite | 0–40 | 0–30 |
| Sulfate | 0–20 | 0–15 |
| Silicate | 0–10 | 0–7 |
| Polymer | 0–10 | 0–7 |
| Process Aids | 0–5 | 0–3 |
| CMC | 0–5 | 0–2 |
| Citrate | 0–5 | 0–3 |
| Optical Brighteners | 0–0.5 | 0–0.3 |

Any conventional organic surfactant may be employed in the practice of the invention. Preferred detergents are anionic surfactants such as alkyl benzenesulfonate salts [linear alkyl benzene-sulfonates (LAS)]. Alkyl sulfate salts, alkyl ethoxysulfonate salts, paraffin-sulfonate salts, α-olefin-sulfonate salts, c-sulfofatty acid ester salts and higher fatty acid salts.

Non-ionic surfactants may also be employed in the practice of the invention, including alkoxylated non-ionic surfactants comprising $C_{12-24}$, preferably $C_{14-18}$, hydrocarbon radicals [saturated or mono-unsaturated, linear or methyl-branched in the 2-position (oxo radical)], preferably derived from naturally occurring or hydrogenated fatty residues and/or synthetic residues, containing an average of 3–20, preferably 4–16, glycol ether moieties. Other suitable non-ionic surfactants include other polyoxyalkylene alkyl or alkenyl ethers, polyoxyethylene alkyl phenyl ethers, higher fatty acid alkanolamides or their alkylene oxide adducts, sucrose fatty acid esters, fatty acid glycerol monoesters and alkylamine oxides.

Inorganic salts suitable for use in the practice of the invention include sodium tripolyphosphate, sodium carbonate, sodium aluminum silicate, sodium sulfate, sodium citrate, sodium amine salts, etc. Functional adjuvants and spray drying process aids are selected from the group consisting of sodium carboxymethylcellulose, EDTA (Ethylene Diamine Tetraacetic Acid), sodium maleate polymers, optical brighteners and silicone antifoam.

Sufficient water is added to the high-shear agglomeration step to maintain the plasticity of the feed stock as discussed above. The amount of water added in each operation will depend, of course, on the nature and amount of the detergent ingredients in the feed stock. The amount of water is empirically determined based on factors such as the desired particle size of the product, product density, granule temperature and formulation. Generally, however, an amount of water in the range of from about 5 to about 20% by weight preferably 10% to 17% by weight based on the weight of the composition in the agglomerator is added.

Although the method of the invention may be carried out batchwise, it is highly preferred to operate the process continuously.

The final product is free-flowing, generally spherical and has a particle size in the range of from about 150 microns to about 2 mm. The product emerging from the agglomerator is dried to its final moisture content preferably by evaporative drying, and most preferably by fluidized bed drying.

EXAMPLES

The following detergent powders were prepared by spray-drying their aqueous slurries. The amounts are given in % by weight.

| | Examples | | | |
|---|---|---|---|---|
| | 1 | 2 | 3 | 4 |
| Moisture | 10.0 | 8.0 | 8.0 | 7.5 |
| LAS (linear alkylbenzene sulfonate) | 8.0 | 7.0 | | 12.0 |
| Non-ionic | | | | 6.0 |
| TPP | | | 63.5 | 65.0 |
| Zeolite | 41.0 | 48.0 | | |
| Sodium Carbonate | 7.0 | 10.5 | | |
| Sodium Sulfate | 23.0 | | 18.25 | |
| Sodium Silicate | | 11.0 | 6.0 | 6.0 |
| Optical Brighteners | | 0.85 | 0.7 | 0.3 |
| Process Aids | 11.0 | 3.65 | 3.55 | 3.2 |
| Polymer | | 11.0 | | |

The physical properties of the spray-dried powders are shown in Table 1:

TABLE 1

| | Examples | | | |
|---|---|---|---|---|
| | 1 | 2 | 3 | 4 |
| Moisture, % | 10.0 | 8.0 | 8.0 | 7.5 |
| Density, g/l | 600.0 | 590.0 | 590.0 | 520.0 |
| Particle size microns | 207–500 | 207–500 | 207–450 | 207–500 |

The spray-dried powders were fed into an 8-inch Zig-Zag® agglomerator at a rate of 200 kg/hr. The powders were agglomerated with tap water at 5–15%. The granularity of the wet agglomerates was similar to the starting powder. The agglomeration conditions are shown in Table 2:

TABLE 2

| | Examples | | | |
|---|---|---|---|---|
| | 1 | 2 | 3 | 4 |
| Intensifier Bar RPM | 1800–2000 | 1000–2200 | 1400–1900 | 1400–1900 |
| Shell RPM | 30 | 30 | 30 | 30 |
| Residence Time, min. | 4–7 | 4–6 | 4–6 | 4–6 |

TABLE 2-continued

| | Examples | | | |
|---|---|---|---|---|
| | 1 | 2 | 3 | 4 |
| Agglomerate Density, g/l | 800–970 | 880–950 | 900–1000 | 900–910 |

After leaving the Zig-Zag® agglomerator, the powders were dried in a fluid bed dryer, thus removing all the water added into the Zig-Zag®. The composition of the original spray-dried powders was maintained. The physical properties of the product leaving the fluid bed dryer are shown in Table 3:

TABLE 3

| | Examples | | | |
|---|---|---|---|---|
| | 1 | 2 | 3 | 4 |
| Moisture, % | 8–10 | 8–10 | 4–5 | 7–10 |
| Density, g/l | 800–970 | 800–900 | 800–850 | 800–900 |
| Particle Size | | | | |
| (% Between 250–500 microns) | 81 | 84 | 91 | 79 |
| Oversize % (>2 mm) | 7 | 7 | 7 | 13 |

A substantial increase in density was achieved without having to change the composition of the starting spray-dried powders.

Finally, the following ingredients were dry-blended to the agglomerated powders using a rotating drum mixer as shown in Table 4. The amounts shown are in % by weight.

TABLE 4

| | Examples | | | |
|---|---|---|---|---|
| | 1 | 2 | 3 | 4 |
| Agglomerated Powder | 57.0 | 59.0 | 59.5 | 66.75 |
| Non-ionic | 4.0 | 4.0 | 9.0 | |
| Perborate | 9.0 | 9.0 | 16.0 | 9.0 |
| Perborate Activator | 4.0 | 4.0 | 1.5 | 4.0 |
| Sodium Carbonate | 6.0 | | 9.5 | |
| Softening Agent | 18.0 | 21.0 | | 17.5 |
| Enzymes | 0.44 | 0.7 | 0.6 | 0.7 |
| Process Aids | 0.56 | 1.55 | 3.53 | 1.28 |
| Perfume | 1.0 | 0.75 | 0.37 | 0.77 |

The density was further increased and the resulting product exhibited good flowability and solubility characteristics.

The physical properties of the final products are shown in Table 5:

TABLE 5

| | Examples | | | |
|---|---|---|---|---|
| | 1 | 2 | 3 | 4 |
| Density, g/l | 900 | 914 | 913 | 980 |
| Flowability, % | 85 | 86 | 86 | 91 |
| Solubility | Good | Good | Good | Good |

Flowability is a measure of the relative flow of a fixed volume of powder through a nozzle compared with sand.

Example 5

The following Examples describe carrying out the process of the invention using a High Efficiency Compactor agglomerator or "HEC" manufactured by Niro Company of Copenhagen, Denmark. The HEC is a high shear agglomerator which provides a high shear particle size reduction and partial agglomeration of the particulate stock and a rotating agglomeration of the partially agglomerated stock to form a high bulk density product similar to that produced with the previously described Zig-Zag® agglomerator. But, unlike the Zig-Zag agglomerator, the steps of high shear agglomeration and rotating agglomeration are not performed sequentially in the HEC agglomerator but rather coincidentally.

The HEC equipment consists of a slow speed rotating drum and a high speed intensifier bar (or shaft) equipped with multiple chopping blades. Agglomerating liquids are generally added at multiple injection points at the top of the drum or from the intensifier bar. The HEC imparts intense mechanical energy via the chopping blades of the intensifier bar for good mixing, softening, compaction, and agglomeration of the powders. The rotating drum provides rotating type agglomeration which increases particle size and sphericity of the agglomerated material. The HEC contains an internal cleaning device to minimize buildup on the drum wall during operation.

The degree of agglomeration/densification can be controlled by a number of factors including (but not limited to) the following: 1) variation of drum angle to increase or decrease residence time (e.g. a higher drum angle increases residence time and agglomeration); 2) variation of the outlet weir height/configuration to increase or decrease residence time; 3) variation of intensifier bar speed; 4) variation of drum speed; 5) position, distribution and amount of agglomerating liquids; and 6) number and type of chopping blades.

The intensifier bar is located below the centerline of the drum and typically rotates in a direction opposite to that of the drum. The HEC apparatus in the following examples consists of a drum 1 m in length and 0.4 m in diameter. The intensifier bar contained 56 individual blades divided into 7 sections. Maximum rotation speeds were 2150 rpm and 50 rpm for the intensifier and drum respectively.

In test configuration, liquids were added via three air atomization nozzles located inside the drum (non-rotating). In addition, liquids were added via one or more nozzles located directly on the intensifier bar.

EXAMPLES

The following detergent powders were prepared by spray drying from aqueous slurries. The composition is presented in Table 6 as percentage by weight.

TABLE 6

| | Examples | |
|---|---|---|
| | 1 | 2 |
| LAS (Linear Alkylbenzene Sulfonate) | 7% | 8% |
| Sodium Tripolyphosphate | 65 | 0 |
| Sodium Aluminum Silicate (Zeolite) | 0 | 42 |
| Sodium Silicate | 5 | 0 |
| Water | 16 | 5–10 |
| Sodium Sulfate | 0 | 20 |
| Others | 7 | 20 |
| Spray tower pour density, g/L | 560 | 590 |

The spray dried powder was fed into the HEC agglomerator and contacted with water under the conditions set forth in Table 7.

TABLE 7

| Agglomeration Conditions | 1 | 2 |
|---|---|---|
| Intensifier Bar Speed, rpm | 1200–1400 | 1300–1700 |
| Rotating Drum Speed, rpm | 28 | 24–32 |
| Water % Added | 17 | 14 |
| Drum Angle | Positive 2° | 0 to +2° |
| Residence Time, min. | 7–8 | 5–8 |
| Agglomerate Density, g/L | 900–1020 | 800–1000 |

After leaving the High Efficiency Compactor agglomerator (HEC), the agglomerates were dried in a fluid bed dryer, removing the additional water added in the HEC. The composition of the original powders was maintained and product flow and granularity were similar to the original spray dried product. The physical properties leaving the fluid bed dryer are shown in Table 8.

TABLE 8

| | Examples | |
|---|---|---|
| | 1 | 2 |
| Moisture, % | 13–15 | 8–10 |
| Particle Size (% Between 150–2000 Microns) | 80 | 94 |
| Oversize % (>2 mm) | 19 | 5 |

What is claimed is:

1. A continuous process for the preparation of a granular detergent composition or component having a bulk density of at least about 700 g/l up to a bulk density of about 1,100 g/l comprising:

(a) providing a low density, particulate detergent or component stock comprising an organic surfactant, a water-soluble inorganic salt and optionally, functional adjuvants and spray drying process aids, said stock having a bulk density of from about 300 g/l to no more than about 600 g/l, (b) subjecting said low density, particulate detergent or component stock to high-shear particle size reduction and agglomeration whereby said particulate stock is subjected to high-shear forces in intimate contact with a liquid consisting of water in an amount and for a time of at least about 4 minutes, sufficient (1) to fluidize, wet with said water, and mechanically mill said stock to a smaller particle size and (2) to partially agglomerate said wetted milled stock; said low density particulate detergent or component stock having essentially the same chemical composition, exclusive of water, as the dried final product of step d;

(c) subjecting said partially agglomerated stock to rotating agglomeration for a time sufficient to produce, when dried, a further agglomerated, granular detergent composition or component having a bulk density of at least 700 g/l wherein said high-shear particle size reduction and said rotating agglomeration steps are performed coincidentally rather than sequentially in an agglomerator which consists of:

(i) a slow speed rotating drum having a drum speed of 24 to 50 rpm; and (ii) a high speed intensifier bar or shaft equipped with chopping blades, said intensifier bar or shaft rotating in a direction opposite to that of the drum and having a rotation speed of 1,200 to 2,150 rpm; and (d) drying said further agglomerated granular detergent composition or component.

2. The process of claim 1 wherein said low density, particulate detergent or component stock is provided by spray-drying a slurry of said organic surfactant, and water-soluble inorganic salt.

3. The process of claim 1 wherein at least a portion of said organic surfactant is an anionic surfactant.

4. The process of claim 1 wherein said inorganic salt is selected from the group consisting of sodium tripolyphosphate, sodium carbonate, sodium aluminum silicate, sodium sulfate, sodium citrate and sodium amine salts.

5. The process of claim 1 wherein said functional adjuvants and spray drying process aids are selected from the group consisting of sodium carboxymethylcellulose, ethylenediaminetetraacetic acid; sodium maleate polymers, optical brighteners and silicone antifoam.

6. The process of claim 1 wherein the amount of said liquid present in said high-shear particle size reduction and agglomeration step is from about 10% to about 17% by weight based on the weight of said low density stock.

7. The process of claim 1 wherein said granular product of step d is free flowing, spherical and has a particle size in the range of from about 150 microns to about 2 mm.

8. The process of claim 1 wherein said further agglomerated granular detergent composition or component is dried by evaporative drying.

9. The process of claim 8 wherein said evaporative drying of said composition or component is conducted in a fluidized bed dryer.

* * * * *